US006898410B2

(12) United States Patent
Boss

(10) Patent No.: US 6,898,410 B2
(45) Date of Patent: May 24, 2005

(54) LOW THERMAL MASS HEATED FUSER

(75) Inventor: Roland Boss, Jalisco (MX)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/996,711

(22) Filed: Nov. 30, 2001

(65) Prior Publication Data

US 2003/0103789 A1 Jun. 5, 2003

(51) Int. Cl.[7] ..... G03G 15/20
(52) U.S. Cl. ..... 399/330; 219/216; 399/328; 399/69
(58) Field of Search ..... 219/216, 469, 219/470, 471; 399/320, 328, 330, 331, 333, 336, 69, 67, 70

(56) References Cited

U.S. PATENT DOCUMENTS 4,372,246 A * 2/1983 Azar et al. ..... 118/60
4,724,303 A 2/1988 Martin et al. ..... 219/216
5,087,946 A 2/1992 Dalal et al.
5,659,867 A 8/1997 Young ..... 399/330
5,708,920 A 1/1998 Ohnishi et al. ..... 399/69
5,869,809 A * 2/1999 Moser ..... 399/69
6,236,830 B1 5/2001 Hoberock et al. ..... 399/330
6,389,261 B1 * 5/2002 Fratangelo et al. ..... 399/328
6,442,366 B1 * 8/2002 Hartley et al. ..... 399/336
6,505,027 B2 * 1/2003 Takeuchi et al. ..... 399/328
6,512,913 B2 * 1/2003 Hirst et al. ..... 399/328

FOREIGN PATENT DOCUMENTS

JP 08-314323 * 11/1996

* cited by examiner

*Primary Examiner*—Hoang Ngo

(57) ABSTRACT

A fuser assembly with a roller having a heat absorptive outer layer on an inner core of a thermally isolating material and a radiant heating element positioned adjacent and external to the outer layer of a roller.

35 Claims, 3 Drawing Sheets

LOW THERMAL MASS HEATED FUSER

TECHNICAL FIELD

The invention relates generally to a fuser for use in an electrophotographic printing device and more particularly, to a radiation heated fuser roller.

BACKGROUND OF THE INVENTION

In electrophotographic printing devices, toner particles are used to form the desired image on the print medium, which is usually some type of paper. Once the toner is applied to the paper, the paper is advanced along the paper path to a fuser. In many printers, copiers and other electrophotographic printing devices, the fuser includes a heated fusing roller engaged by a mating pressure roller. As the paper passes between the rollers, toner is fused to the paper through a process of heat and pressure.

A variety of different techniques have been developed to heat the fusing roller. One of the most common techniques for heating a fusing roller uses a quartz lamp placed inside the roller. The lamp is turned on to heat the fusing roller during printing. In this configuration, the roller is typically made of a central core of a material having a high level of heat conductivity such as aluminum or similar metal or alloy. The central core may be covered by an elastic or rubber coating to facilitate fusing of the plastic ink media (i.e., toner) onto a paper or other web-like printing substrate. One example of the state of the art in this field is U.S. Pat. No. 6,236,830 (the "'830 patent") issued May 22, 2001 to Hoberock, et al. describes a heated fuser roller including a series of heating wires embedded within the roller. The '830 patent is expressly incorporated by reference herein in its entirety.

Heat generated by the lamp must heat the entirety of the roller prior to operation of the device. Since the roller constitutes a significant thermal mass, it requires substantial time and energy to raise the temperature of the roller to an acceptable operating range.

So called "instant-on" fusers were developed to reduce warm-up time, eliminate the need for standby power and improve print quality in single page or small print jobs. U.S. Pat. Nos. 5,659,867 (the "'867 patent"), 5,087,946 (the "'946 patent"), and 4,724,303 (the "'303 patent") describe instant-on type fuser heaters that utilize a thin walled heated fusing roller. In the '867 patent, the heating element is a group of resistive conductors positioned on the surface of a thin walled ceramic tube. The conductors are overlaid with a glassy coating to provide a smooth exterior surface for the ceramic tube. In the '946 patent, the heating element is a conductive fiber filler material added to the plastic composition that forms the wall of the roller. In the '303 patent, the heating element is a resistance heating foil or printed circuit glued to the inside surface of the thin metal wall of the roller.

While these "instant-on" fusers having embedded heating elements may be advantageous because the heating element is near the surface of the roller, substantial changes must be made to conventional fuser roller designs to incorporate both techniques. Hence, these techniques cannot be easily incorporated into the more common fuser roller designs. Further, in contrast, conventional internal heating of a fuser roller takes substantial warm-up time and associated energy requirements.

BRIEF SUMMARY OF THE INVENTION

Preferred embodiments of the invention provide a fuser assembly comprising a roller having a heat absorptive outer layer on an inner core of a thermally isolating material and a radiant heating element positioned adjacent and external to the outer layer of a roller.

DETAILED DESCRIPTION OF THE INVENTION

The present invention is directed to a heated fuser roller that has a low thermal mass outer heating layer supported by a thermally isolating inner core. A radiant heating element is positioned adjacent the roller, near a contact region with a media to be fused. The heating element radiantly heats the outer layer of the fuser roller. The fuser roller includes an elongated cylinder having a core of thermally isolating material and an outer layer of a low thermal mass such as a very thin sheet of metal or metallic coating. The heating element may be a quartz lamp. Temperature sensors may be positioned in contact with or near the roller to detect roller temperature. Operating temperature may be maintained by controlling power supplied to the heating element. In addition to a target temperature value, a controller may receive additional parameters used to calculate a power requirement of the heating element including, for example, toner specific fusing requirements (e.g., heat energy required per unit weight or volume of applied toner) the average or maximum density of toner to be fused, media speed (e.g., paper transport speed), heater efficiency, ambient conditions (e.g., air temperature, humidity), etc and other parameters affecting the amount of heat energy required.

Figure 1:
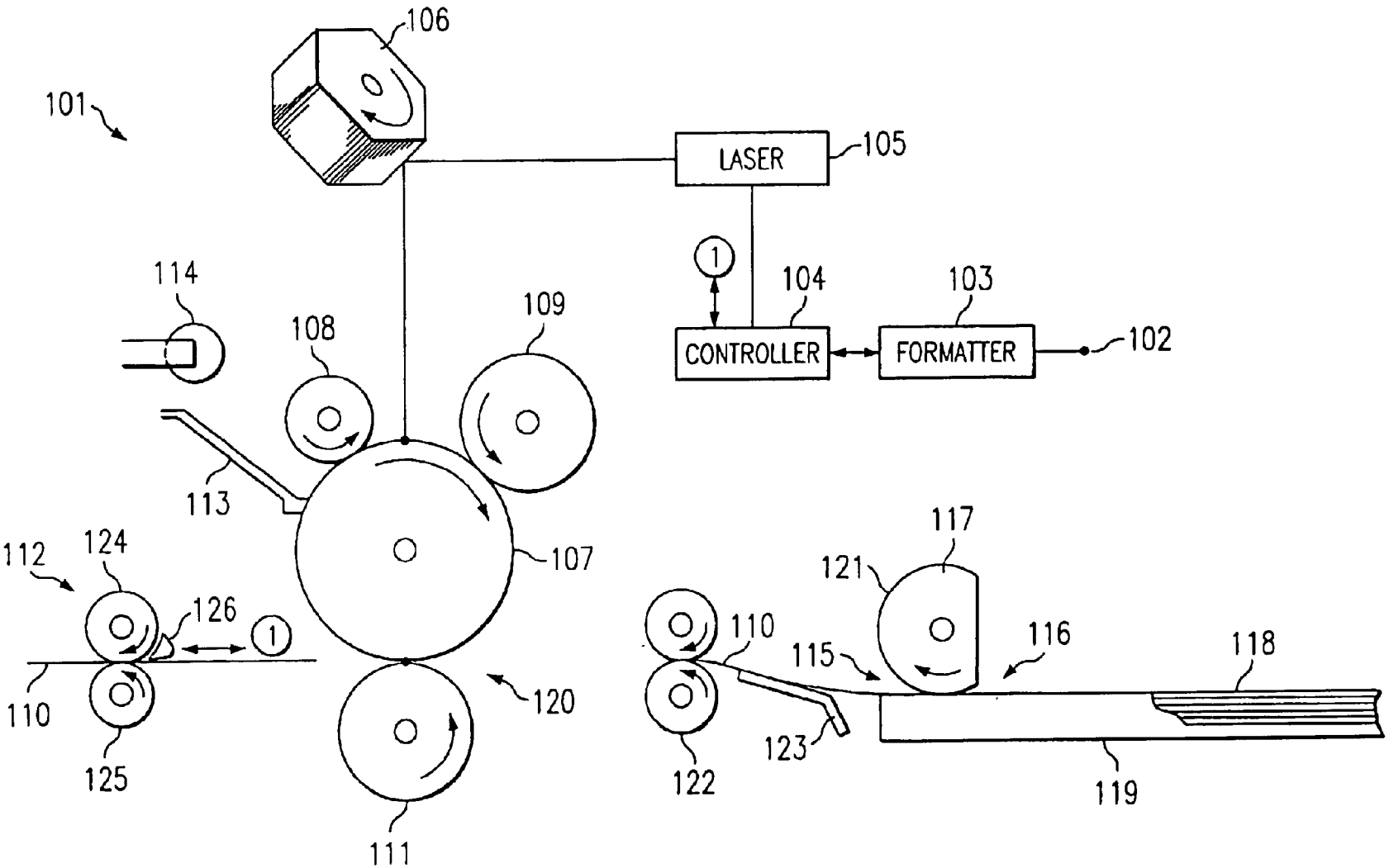
FIG. 1 is a schematic diagram of a laser printer including a low thermal mass heated fusing roller according to an embodiment of the invention.

FIG. 1 illustrates a laser printer, designated by reference number 101, that incorporates one embodiment of the present invention. In general, and referring to FIG. 1, a computer transmits data representing an image to input port 102 of printer 101. This data is analyzed in formatter 103. Formatter 103 may include a microprocessor, a related programmable memory and a page buffer. Formatter 103 formulates and stores an electronic representation of each page to be printed. Once a page has been formatted, the electronic representation of each page may be transmitted to the page buffer. The page buffer breaks the electronic page into a series of lines one dot wide. This line of data is sent to the printer controller 104. Controller 104, which also preferably includes a microprocessor and programmable memory, drives laser 105 and controls the drive motor(s), fuser temperature and pressure, and the other print engine components and operating parameters.

Each line of data is used to modulate the light beam produced by laser 105. The light beam is reflected off a multifaceted spinning mirror 106. As each facet of mirror 106 spins through the light beam, it reflects or "scans" the beam across the side of a photoconductive drum 107. Photoconductive drum 107 rotates just enough that each successive scan of the light beam is recorded on drum 107 immediately after the previous scan. In this manner, each line of data is recorded on photoconductive drum 107. Toner is electrostatically transferred from developing roller 109 onto photoconductive drum 107 according to the data previously recorded on the drum. The toner is thereafter transferred from photoconductive drum 107 onto media 110 (e.g., paper) as media 110 passes between drum 107 and pressure roller 111. Drum 107 is cleaned of excess toner with cleaning blade 113. Drum 107 may be completely discharged by discharge lamps 114 before a uniform charge is restored to drum 107 by charging roller 108 in preparation for the next toner transfer.

Each sheet of media 110 is advanced to the photoconductive drum 107 by a pick/feed mechanism 116. Pick/feed mechanism 116 includes motor driven feed roller 117 and registration rollers 122. A paper stack 118 is positioned in input tray 119 to allow sliding passage of the top sheet of media 110 into pick/feed area 115 at the urging of feed roller 117. In operation, as feed roller 117 rotates, the frictionally adherent outer surface 121 of feed roller 117 contacts the upper surface of media 110 and pulls it into pick/feed area 115. As the leading edge of media 110 moves through pick/feed area 115, it is engaged between the pair of registration rollers 122. A ramp 123 helps guide media 110 into registration rollers 122. Registration rollers 122 advance media 110 along the media travel path 120 until it is engaged between drum 107 and pressure roller 111 where toner is applied to the paper as described above.

Once the toner is applied to media 110, it is advanced along the paper path to fuser 112. Fuser 112 includes a heated fusing roller 124 and a pressure roller 125. As the paper passes between the rollers, toner is fused to the paper through a process of heat and pressure. Heated fusing roller 124 is heated by heating element 126. According to a preferred embodiment, heating element 126 may be a quartz lamp powered by a suitable power supply under the control of controller 104, see e.g., the control link illustrated therebetween coupled at the point designated 1, so as to radiationally heat an outer layer of heated fusing roller 124.

Figure 2:
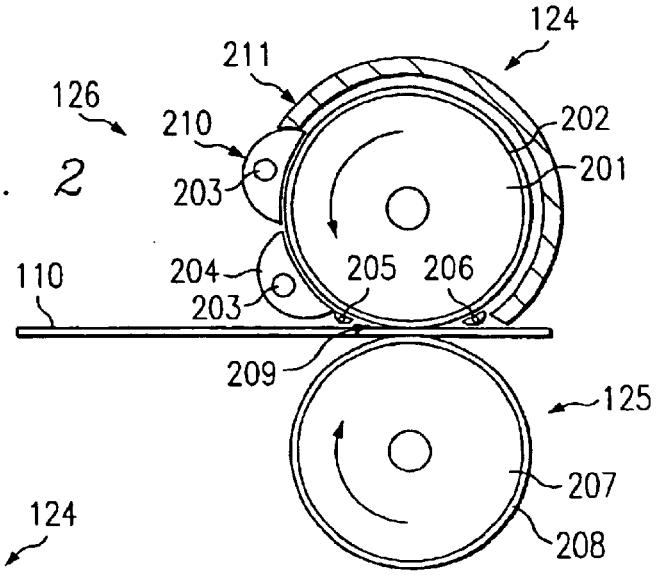
FIG. 2 is a side view of an embodiment of the invention with a heated fusing roller having a low thermal mass outer layer.

Referring now to FIG. 2, a preferred embodiment heated fusing roller 124 includes a central core 201 of a thermally isolating material, such as may be comprised of a solid, foamed, or particulate material, such as polyurethane, polystyrene, glass fibre, rubber, porcelain, mica, asbestos, cork, or kapok, or even air suitably enclosed or otherwise controlled. This central core may be solid material with a central bore for receiving an axle or shafts to provide for the rotation of roller 124 in the indicated direction to advance media 110. Thus, shafts of the fuser roller 124 may be mounted on bearings (not shown) which are biased to press the fuser roller 124 against pressure roller 125. Fusing roller 124 and pressure roller 125 are opposed to form a nip region 209. Toner is fused to media 110 in nip region 209. One or both rollers 124 and 125 are motor driven to advance media 110 through nip region 209.

As shown in FIG. 2, fusing roller 124 may be constructed with a thermally isolating core 201 and thin heating layer 202 made of a suitable thermal mass compatible with a heating element, such as a very thin sheet metal or a metallic coating or even a non-metallic surface having suitable heat absorbing characteristics. For example, heating layer 202 may be made of a metal, such as darkened aluminum, stainless steel, tungsten, metalized rubber, a suitable ceramic, etc. Heating layer 202 is preferably of sufficient thermal mass to provide adequate heat energy at a preferred operating temperature to melt or fuse all toner powder applied to media 110, while having a sufficiently small thermal mass to provide for its "instantaneous" heating to such operating temperature by the heating element, e.g., adapted to heat to a desired temperature in a time a surface portion is exposed to the radiant heat of the heating element. Heating layer 202 is also preferably of a suitable thermal energy absorption characteristic to provide for efficient heating by the heating element. For example, according to a preferred embodiment heating layer 202 should have an exposed surface capable of absorbing heat radiation emitted in the form of visible and/or infrared light emitted by a quartz or halogen lamp forming the heating element.

The surface of fusing roller heating layer 202 may be a dark or essentially black highly absorptive color, preferably having a select surface such as used in solar collectors, i.e., having a high absorptivity but low emissivity. That is, a select surface, such as that provided by oxidized copper, has a high absorbtivity at a specified wavelength (e.g., visible light) but a low emissivity at infrared. Heat energy from a particular source may be readily absorbed by such a surface substantially without its being radiated away and, therefore, is conserved for contact with the media and/or toner to be fused.

Heating layer 202 should readily absorb heat from the heating element and retain the heat until coming into contact with media 110. Thus, the thermal characteristics of heating layer 202 allow it to be heated rapidly to an operational temperature while it is being rotated from a heating zone to a contact region of nip region 209. By proper selection of the thermal characteristics of heating layer 202 and the geometry (e.g., total surface area) of the exposed area provide very-quick-on fusing. Since substantially only the heat quantity needed to accomplish fusing must be transported from the heat source to the contact zone, the total energy consumption is much lower than required by conventional fusers.

Energy may be further conserved by appropriate shielding of the roller as provided by heat shield 211. Heat shield 211 may be made of a thermal insulating material, preferably including an inner heat reflective surface facing fusing roller 124, so as to avoid radiational heat loss. For example, heat shield 211 may be comprised of a foam material, such as polyurethane foam, that is resistant to high temperatures, preferably having a reflective surface thereon disposed to reflect heat toward fusing roller 124.

Heating layer 202 may include an outer layer made of a hard "release" material such as TEFLON® (not shown). Preferably, such a release material, when used, is selected to cooperate with the remaining fuser roller structure to form a heat absorbent outer layer to provide for radiational heating of fusing roller 124 by heating element 126 according to the present invention.

Figure 6:
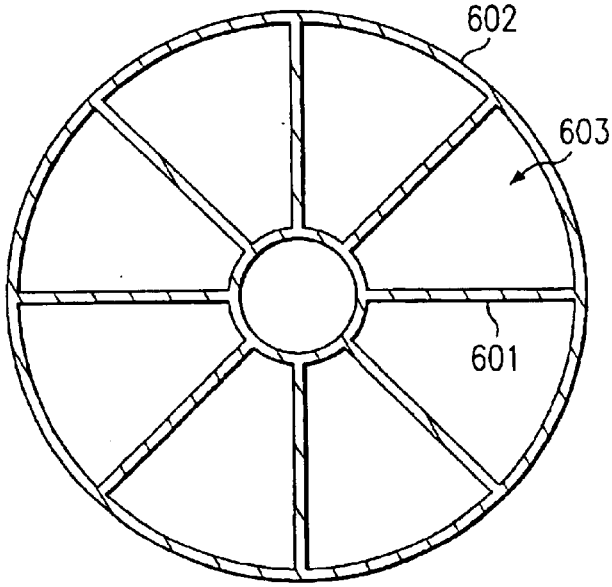
FIG. 6 is a sectional view of a machined fusing roller having a skeletal inner structure to minimize an internal thermal mass of the roller.

Although shown as a solid, core 201 may be hollow, e.g., utilizing an air core with appropriate supports to engage an axle or supporting/driving shaft structures as shown in FIG. 6. Referring to FIG. 6, fusing roller 124 may have a skeletal inner structure to minimize internal thermal mass of the roller. This structure may include continuous ribs 601 radially extending from a central shaft region to an outer cylindrical portion 602. Voids 603 are preferably filled with air to reduce the thermal mass of the interior portion of the roller. Ends of the roller may be sealed to avoid heat loss caused by airflow through voids 603. Alternatively, airflow though voids 603 may be induced to provide a source of heated air, such as to preheat the media prior to fusing. As another alternative, a series of radial posts or spokes spaced along the length of the roller may be substituted for continuous ribs 601.

Figure 7:
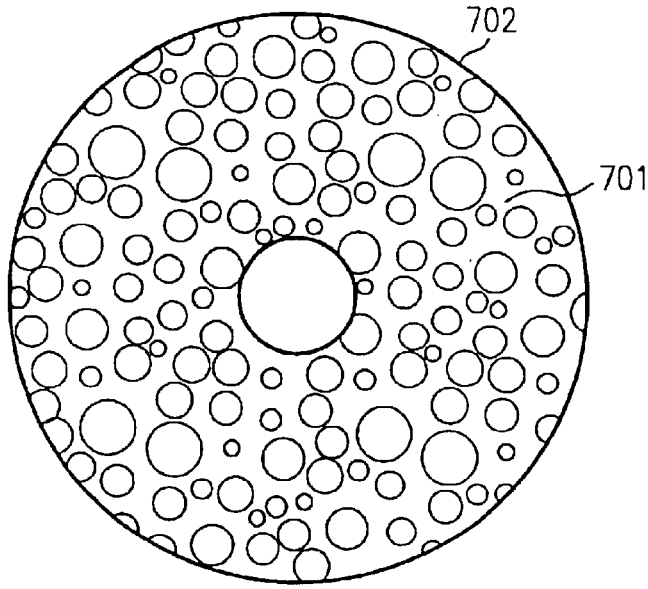
FIG. 7 is a sectional view of a fusing roller using a foam construction.

Although heating layer 202 is shown as distinct from underlying core 201, fusing roller 124 may instead be formed of a single material or composite material. The material may advantageously exhibit a thermal conductivity selected to minimize heat flow (i.e., heat loss) from the surface to inner portions of the roller, while providing sufficient thermal capacity to absorb and retain sufficient thermal energy to fuse, via contact with a media, a desired amount of toner onto the media. Certain ceramics, for example, may provide the required heat capacity while minimizing heating requirements caused by conductive parasitic heating of an inner portion of the roller. Alternatively, as shown in FIG. 7, the fusing roller may be of a homogeneous construction including a single material formed to have a low internal thermal mass but a high surface thermal mass. Thus, the main body of a fusing roller may be formed entirely from foam material 701 having numerous interstitial gas bubbles internal to the roller and a smooth solid outer surface or "skin" 702. Such a foam 701 may be made of a polyurethane or similar material that is formed with such a porous internal structure and smooth, non-porous outer layer skin 702.

Referring again to FIG. 2, the heating element may be implemented by one or more heating arrays 210. According to a preferred embodiment of the invention, the heating element may include multiple heating arrays 210 spaced along the circumference of fusing roller 124. Of course, other configurations of heating arrays may be used, if desired. For example, a single heating array may be utilized according to the preferred invention. Moreover, the disposition of the heating array need not be as illustrated. For example, one or more heating array may be disposed at various positions radially with respect to fuser roller 124.

The heating arrays may derive their heat from lamps 203. The lamp may be a quartz or halogen type lamp or other suitable heating element, such as an IR radiation source, and may be surrounded by an appropriate heat reflector 204 positioned adjacent and along the length of fusing roller 124. Provision of multiple heating arrays may provide for increased heat generation while avoiding excessive operating temperatures and hot spots. This configuration also supports dynamic control of fuser heating to respond to varying fuser heat requirements as determined by the type of media and toner, media speed, etc. For example, having multiple heating arrays with selective control over each array provides a wide range of thermal excitation energies available to heat fusing roller 124. Further, the use of multiple arrays provides for greater thermal energy without use of excessively high temperatures that might be required to transfer an equivalent amount of thermal energy using a single array. Thus, because fusing roller 124 has a low thermal mass, its surface temperature and stored thermal energy may be dynamically controlled by heating arrays 210. Heating may be controlled in response to roller temperature measurements and anticipated heat loss based on known or predicted media fusing requirements.

Heat reflector 204 may be positioned and/or extended to both focus radiation from lamp 203 onto heating layer 202 and to reduce radiational losses from heating layer 202 by reflecting IR radiation back to heating layer 202. Heating element 126 is preferably positioned near nip region 209 to heating layer 202 immediately prior contacting media 110 and fusing toner previously applied onto the media.

Pressure roller 125, preferably disposed to define nip region 209 in cooperation with fusing roller 124, is typically constructed with a metal core 207 and a pliable outer layer 208. Pressure roller 125 may also include a thin TEFLON® release layer (not shown).

One or more temperature sensors, 205, 206 may be located on either side of nip region 209, each providing an appropriate output to controller 104 so as to maintain heating layer 202 at an appropriate operating temperature. The operating temperature of layer 202 is dependent on toner requirements, typically in the range of 160 to 200 degrees Celsius and, more preferably between 165 and 175 degrees Celsius, a typical temperature being 170 degrees Celsius. Temperature sensors 205 and 206 may be suitable infrared (IR) heat detectors, thermocouple type devices proximate to or in contact with heating layer 202, or other forms of temperature transducers which are operational in the desired temperature range and which have the requisite accuracy.

Providing sensors on either side of nip region 209 allows monitoring of the temperature of heat layer 202 immediately after heating by heating element 126 and after heat loss caused by fusing of toner powder onto receiving media 110. In response, and so as to ensure that adequate heat is applied to properly fuse the toner powder onto the media, heating element 126 may be modulated, i.e., operated to provide a desired heating effect. This modulation may further take into account other factors, such as the amount of toner powder being applied at any time (i.e., dependent on toner density for a given image production.), type of toner, media type and/or size and thickness, ambient conditions (e.g., air temperature, humidity, etc.) This dynamic "closed-loop" system allows rapid initial heating of the heating layer and decreased heating and power consumption after reaching operating temperature. Since only sufficient heat is added to compensate for heat loss caused by fusing operations (and, or course, parasitic heat loss to adjacent structures), power consumption is minimized. Control may also include selective activation of heating arrays 210 as necessary to generate sufficient heat energy. In addition to detecting and using a temperature differential between sensors 205 and 206 to dynamically adjust the activation and heating intensity of heating arrays 210, this information may also be used to obtain other useful parameters, such as media thickness, etc., to be used in later processing. For example, media thickness affects the heat absorption properties of the media, thicker paper stock creating a greater temperature differential for a given thermal energy. Thus, it is possible to detect media thickness based on the resultant temperature differential for a predetermined amount of thermal energy applied. Heat shield 212 is positioned proximate layers 202 to minimize radiated thermal loses.

Figure 3:
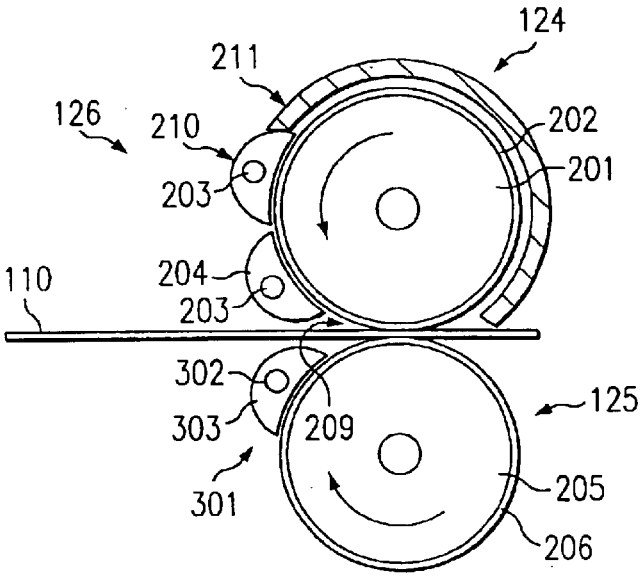
FIG. 3 is a side view of an embodiment of the invention with a heated fusing roller having a low thermal mass outer layer augmented by a heated opposing pressure roller.

FIG. 3 is a diagram of another embodiment of the invention in which both fusing roller 124 and pressure roller 125 are heated using a lower thermal mass layer and heat radiation source. Heating media 110 from both sides enhances certain fusing operations and provides additional heat energy for fusing operations. Thus, pressure roller 125 of this embodiment preferably includes a core 207 made of a thermal insulator (instead of a metal) and a thin metal, or other heat conductive material, outer layer 208 heated by heating array 301. Outer layer 208 may also include an elastic or rubberized exposed layer to help engage and transport media 110 through nip region 209.

Heating element 301 may include a heating lamp 302 and reflector 303 concentrating radiant energy from lamp 302 onto pressure roller 125. Although not shown in the figure, appropriate temperature sensors may be positioned along pressure roller 125, such as on either side of nip region 209 as described above. These temperature sensor may provide a feedback signal representative of the temperature of the roller and may be used to provide for the activation and operation of heating element 301 to maintain a desired temperature. Dynamic control of the amount of heat generated by a heating element may be accomplished using conventional analog adjustment of the current supplied to one or more of the constituent heating arrays 210, pulse width modulation of the current (e.g., "chopping"), selective activation of arrays, etc.

Figure 4:
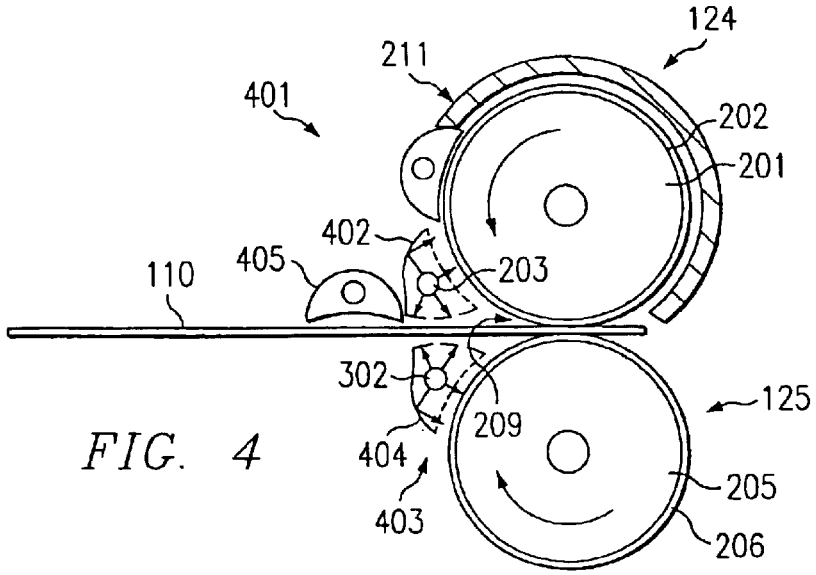
FIG. 4 is a side view of an embodiment of the invention with heated fusing and pressure rollers having low thermal mass outer layers including preheating of a media prior to engagement by the rollers.

FIG. 4 is another alternative embodiment of the invention in which heating elements 401 and 403 are modified to provide for direct, preheating of media 110 from above and below, prior to entering nip region 209. Thus, heating element 401 includes heat reflector 402 having a main, IR transparent aperture directed toward fusing roller 124 and a second, at least partially IR transparent aperture for transmitting heat energy directly to a top layer of media 110 as it enters nip region 209. The amount of preheating may be controlled by providing a suitable configuration and heat distribution between the roller facing and media facing apertures. For example, the size and/or shape of the lower, media facing aperture may be configured to allow a desired portion of IR radiation to be directed to the underlying media, with a main portion of the radiation continuing to be directed toward and used to heat fusing roller 124. A similar configuration may be incorporated into a heating element 403 used to heat pressure roller 125, including a heat reflector 404 configured to distribute IR radiation to both the roller and the underside of media 110.

In addition to or instead of redirecting a portion of heat energy from heating elements 401 and 403, one or more auxiliary media/toner preheat units 405 may be positioned along a path prior to the media entering nip region 209. Although shown to preheat a top of media 110 onto which toner powder is applied and awaiting fusing, similar preheat units may be located elsewhere including, for example, to heat an underside of media 110, such as positioned adjacent heating element 403.

Figure 5:
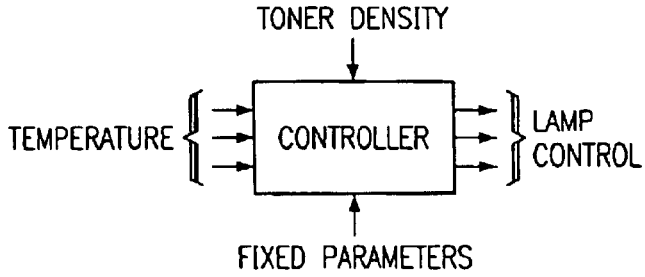
FIG. 5 is a block diagram of a controller configured for regulating heating of a fusing roller.

FIG. 5 is a block diagram of a control circuit for operating the heating elements. The controller may be dedicated to heater control or may be a function incorporated into controller 104 (FIG. 1). Inputs to the controller preferably include signals from the various temperature sensors 205, 206, etc., an indication of the toner density to be fused by the corresponding section of the fuser, fixed parameters such as the design operating temperature of the toner powder being used, and/or other factors (not shown) such as ambient air temperature and humidity. Responsive to these quantities, various lamp control signals are generated to cause respective lamps to provide appropriate heat energy to maintain fuser temperatures within desired operating ranges.

Although the invention has been shown and described with reference to a pressure roller in a laser printer fuser, the invention may be embodied in other components and printing devices. For example, although the outer surface of fusing roller 124 may still receive a coating of TEFLON®, it is expected that outer layer 202 may be made of a hard rubber compound. The heated fuser roller of this invention is also suitable for use in all types of laser printers, copiers, facsimile machines and the variety of other electrophotographic printing devices that use a heated roller fuser. Therefore, it is to be understood that the invention may be embodied in other forms and details without departing from the spirit and scope of the invention as defined in the following claims.

What is claimed is:

1. A fuser assembly, comprising:

a roller;

a radiant heating element;

a controller configured to detect a thermal property of said roller and, in response, dynamically control said heating element, wherein said thermal property includes a differential temperature measured on either side of a nip region of said roller.

2. The fuser assembly according to claim 1 further comprising a temperature transducer configured to detect a surface temperature of said roller.

3. The fuser assembly according to claim 1 wherein said controller is further responsive to a quantity of toner applied to a section of media corresponding to a section of said roller heated by said heating element.

4. The fuser assembly according to claim 1 wherein said radiant heating element comprises:

a heating array; and a heat deflector disposed to direct at least a portion of heat radiated by said heating array toward said roller.

5. The fuser assembly according to claim 4 wherein said heat deflector also directs at least a portion of heat radiated by said heating array toward a media to thereby preheat said media prior to engaging said roller.

6. The fuser assembly according to claim 4 wherein said heat deflector is substantially fabricated from a foam material.

7. The fuser assembly according to claim 1 further comprising a media preheating element configured to radiationally heat said media prior to being received by said roller.

8. The fuser assembly according to claim 1 wherein said heating element includes a plurality of longitudinally oriented heating arrays circumferentially spaced along a periphery of said roller.

9. The fuser assembly according to claim 8 wherein each of said plurality of heating arrays is configured to be individually controllable.

10. The fuser assembly according to claim 1 wherein said inner core is substantially fabricated from a foamed material or a particulate material.

11. The fuser assembly according to claim 1, wherein said inner core is substantially fabricated from a material selected from the group comprising: polyurethane; polystyrene; glass fibre; rubber; porcelain; mica; asbestos; cork; kapok; and air.

12. The fuser assembly according to claim 1 wherein said outer layer is substantially fabricated from a material selected from the group comprising: aluminum; stainless steel; copper; tungsten; metalized rubber; and ceramic.

13. The fuser assembly according to claim 1 wherein said roller comprises a skeletal inner structure.

14. The fuser assembly according to claim 13 wherein said skeletal inner structure defines at least one void that is configured to contain air.

15. The fuser assembly according to claim 13 wherein said skeletal inner structure comprises at least one rib radially extending from a central shaft region to an outer cylindrical portion.

16. The fuser assembly according to claim 13 wherein said skeletal inner structure comprises at least one spoke radially extending from a central shaft region to an outer cylindrical portion.

17. A fuser assembly, comprising:

a roller comprising a metal heat absorptive outer layer on an inner core of thermally isolating material;

a radiant heating element positioned adjacent and external to said outer layer of said roller, and comprising a heating array and a heat deflector disposed to direct at least a portion of heat radiated by said heating array toward said roller; and, a controller configured to detect a thermal property of said roller and, in response, dynamically control said heating arrays, wherein said thermal property includes a differential temperature measured on either side of a nip region of said roller.

18. A heated fuser, comprising:

a fusing roller comprising low thermal mass outer layer surrounding a thermally isolating core;

a pressure roller comprising an elastomeric outer layer, the pressure roller disposed adjacent to the fusing roller;

a pair of temperature sensors configured to measure a temperature differential therebetween; and a radiant heating device disposed external to said fusing roller and configured to heat said low thermal mass outer layer of said fusing roller to a desired operating temperature.

19. The heated fuser according to claim 18 wherein said outer layer is metal.

20. The heated fuser according to claim 18 wherein said radiant heating device is further configured to heat a media prior to said media engaging said fusing roller.

21. The fuser assembly according to claim 20 further comprising an auxiliary media/toner preheat unit configured to heat said media.

22. The fuser assembly according to claim 20 wherein said radiant heating device comprises a heat deflector that defines:

a main aperture configured to direct heat energy therethrough and toward said fusing roller; and and a second aperture configured to direct heat energy therethrough and toward said media.

23. The fuser assembly according to claim 18, wherein:

said fusing roller and said pressure roller together form a nip region that has an infeed side and an opposite outfeed side;

one of said pair of temperature sensors is positioned proximate said fusing roller and configured to detect a surface temperature thereof on said infeed side of said nip region; and another of said pair of temperature sensors is positioned proximate said fusing roller and configured to detect a surface temperature thereof on said outfeed side of said nip region.

24. The fuser assembly according to claim 18, wherein:

said fusing roller and said pressure roller together form a nip region that has an infeed side and an opposite outfeed side;

one of said pair of temperature sensors is positioned proximate said fusing roller and configured to detect a surface temperature thereof on said infeed side of said nip region; and another of said pair of temperature sensors is positioned proximate said pressure roller and configured to detect a surface temperature thereof on said outfeed side of said nip region.

25. The fuser assembly according to claim 18, wherein:

said fusing roller and said pressure roller together form a nip region that has an infeed side and an opposite outfeed side;

one of said pair of temperature sensors is positioned proximate said pressure roller and configured to detect a surface temperature thereof on said infeed side of said nip region; and another of said temperature sensors is positioned proximate said fusing roller and configured to detect a surface temperature thereof on said outfeed side of said nip region.

26. The fuser assembly according to claim 18, wherein:

said fusing roller and said pressure roller together form a nip region that has an infeed side and an opposite outfeed side;

one of said pair of temperature sensors is positioned proximate said pressure roller and configured to detect a surface temperature thereof on the infeed side of said nip region; and, another of said pair of temperature sensors is positioned proximate said pressure roller and configured to detect a surface temperature thereof on said outfeed side of said nip region.

27. A method of fusing toner onto a media comprising:

heating a fusing roller using only radiant heat directed toward a surface of said fusing roller;

forming a nip region between said fusing roller and a pressure roller, wherein said nip region has an infeed side and an outfeed side;

transporting the media into rolling contact with said fusing roller and through the nip region to simultaneously heat said toner to a desired temperature and apply pressure to the toner causing the toner to fuse to the media; and detecting a temperature differential between said infeed side and said outfeed side of said nip region.

28. The method according to claim 27 further comprising:

applying the toner to the media;

radiationally preheating the toner on a portion of the media prior to transporting said media into rolling contact with said fusing roller.

29. The method according to claim 27 further comprising controlling heating of said fusing roller in response to detecting said temperature differential.

30. The method according to claim 29 further comprising:

ascertaining an additional parameter; and controlling heating of said fusing roller in response to ascertaining said additional parameter.

31. The method according to claim 30 wherein said additional parameter is selected from the group comprising: heat energy required per unit weight of applied toner; heat energy required per unit volume of applied toner; average density of toner to be fused; maximum density of toner to be fused; media speed; heater efficiency; ambient air temperature; and, ambient air humidity.

32. The method of claim 27, further comprising detecting a media thickness in response to detecting said temperature differential.

33. The method of claim 27, further comprising heating said pressure roller using only radiant heat directed toward a surface of said pressure roller.

34. A fusing method, comprising:

detecting a temperature differential measured between an input side and an output side of a nip region of a pair of rollers; and controlling a temperature of a heating element based on the temperature differential.

35. A fusing apparatus, comprising:

a pair of rollers defining a nip region;

a pair of temperature sensors configured to measure a temperature differential across the nip region;

a heating element; and a controller configured to control the heating element based on the temperature differential.

* * * * *

UNITED STATES PATENT AND TRADEMARK OFFICE

CERTIFICATE OF CORRECTION

PATENT NO. : 6,898,410 B2
DATED : May 24, 2005
INVENTOR(S) : Boss

It is certified that error appears in the above-identified patent and that said Letters Patent is hereby corrected as shown below:

Column 9,
Line 30, before “a”, delete “and”.

Signed and Sealed this

Thirteenth Day of December, 2005

JON W. DUDAS
*Director of the United States Patent and Trademark Office*